US005546842A

United States Patent [19]

Pimentel

[11] Patent Number: 5,546,842

[45] Date of Patent: Aug. 20, 1996

[54] RECORDING SENSOR MOUNTING RAIL FOR KEYBOARD OPERATED MUSICAL INSTRUMENT

[75] Inventor: Robert L. Pimentel, Sacramento, Calif.

[73] Assignee: Burgett, Inc., Sacramento, Calif.

[21] Appl. No.: 502,083

[22] Filed: Jul. 13, 1995

[51] Int. Cl.[6] ..... G10G 3/00

[52] U.S. Cl. ..... 84/461; 84/432

[58] Field of Search ..... 84/432, 441, 461, 84/DIG. 7, 626

[56] References Cited

U.S. PATENT DOCUMENTS

| | | | |
|---|---|---|---|
| 4,974,482 | 12/1990 | Tamaki et al. | 84/653 |
| 5,010,799 | 4/1991 | Tanaka et al. | 84/627 |
| 5,237,125 | 8/1993 | Fields | 84/626 |

*Primary Examiner*—Patrick J. Stanzione
*Attorney, Agent, or Firm*—John P. O'Banion

[57] ABSTRACT

An extruded recording sensor mounting rail for keyboard operated musical instruments, particularly electronic player pianos, which can be used to install recording sensors in a new or existing piano and provide for accurate alignment of the sensors with the individual keys in the instrument. A first flange extending along the rear of the mounting rail is configured for receiving one edge of a circuit board in a sensor assembly, while a second flange and shelf extending along the front of the mounting rail are configured for supporting the other edge of the circuit board and flexible recording sensors. Each flange also includes longitudinal slots for receiving fasteners for joining multiple mounting rails in an end to end configuration so that mounting rail assemblies of varying lengths can be fashioned to accommodate different keyboard sizes and key spacing configurations.

10 Claims, 4 Drawing Sheets

RECORDING SENSOR MOUNTING RAIL FOR KEYBOARD OPERATED MUSICAL INSTRUMENT

BACKGROUND OF THE INVENTION

1. Field of the Invention

This invention pertains generally to recording keystroke information in a keyboard operated musical instrument, and more particularly to a mountain rail assembly for supporting keystroke recording sensors beneath the keys in an electronic player piano.

2. Description of the Background Art

Recording sensors are commonly used in electronic player piano systems to capture keystroke information. Typically, sensor assemblies are mounted below the keyboard to sense the movement and position of the keys for recording the original piano performance. In conventional player piano systems, the sensor assemblies are mounted on a common rack assembly which is sized to match the size of the keyboard. Since the rack assembly must be sized to match the size of the keyboard, it is necessary to customize the rack assembly for different types of player pianos.

Further, such rack assemblies do not provide for adjustability of the position of the sensors in relation to the keys. In the piano industry, however, there are at least four distinct piano key spacing arrangements. It will be appreciated that, in a player piano, there is a large number of individual keys to be sensed in a player piano. Thus there is a need for an apparatus which will allow for sensing key movement without interfering with the key movement and, further, a need for each sensor to be accurately positioned in relation to the corresponding key. There is a further need for sensor assemblies which can be easily retrofitted to existing pianos with varying keyboard sizes and key spacing configurations. The present invention satisfies those needs, as well as others, and overcomes the deficiencies found in conventional sensor assembly mounting techniques.

SUMMARY OF THE INVENTION

The present invention pertains to a recording sensor mounting rail assembly for keyboard operated musical instruments, particularly electronic player pianos, which can be used to install recording sensors in a new or existing piano and provide for accurate alignment of the sensors with the individual keys in the instrument.

By way of example, and not of limitation, the invention comprises an elongated mounting rail which is extruded as an integral component. A rectilinear flange extends along the rear of the mounting rail, while an arcuate flange extends along the front of the mounting rail. An open channel extends between the two flanges for receiving a sensor assembly. The rectilinear flange includes a longitudinal slot for receiving one edge of the sensor assembly, while the other edge of the sensor assembly rests on a shelf adjacent to the arcuate flange and is held in place by compression using a compression rail. The shelf also includes a longitudinal slot for receiving a fastener which extends through and secures the compression rail to the shelf. Also provided in each flange are longitudinal slots for receiving fasteners which can be used to secure a plurality of mounting rails in an end to end configuration so that mounting rail assemblies of varying lengths can be fashioned to accommodate different keyboard sizes and key spacing configurations.

An object of the invention is to provide a recording sensor mounting rail which permits accurate alignment of the recording sensors in relation to the keys in a keyboard operated musical instrument.

Another object of the invention is to provide a recording sensor mounting rail which allows multiple rails to be connected to accommodate different sizes of keyboards.

Another object of the invention is to provide a recording sensor mounting rail which can be easily retrofitted to existing keyboards.

Another object of the invention is to provide a recording sensor mounting rail which provides for stable mounting of recording sensor assemblies.

Further objects and advantages of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
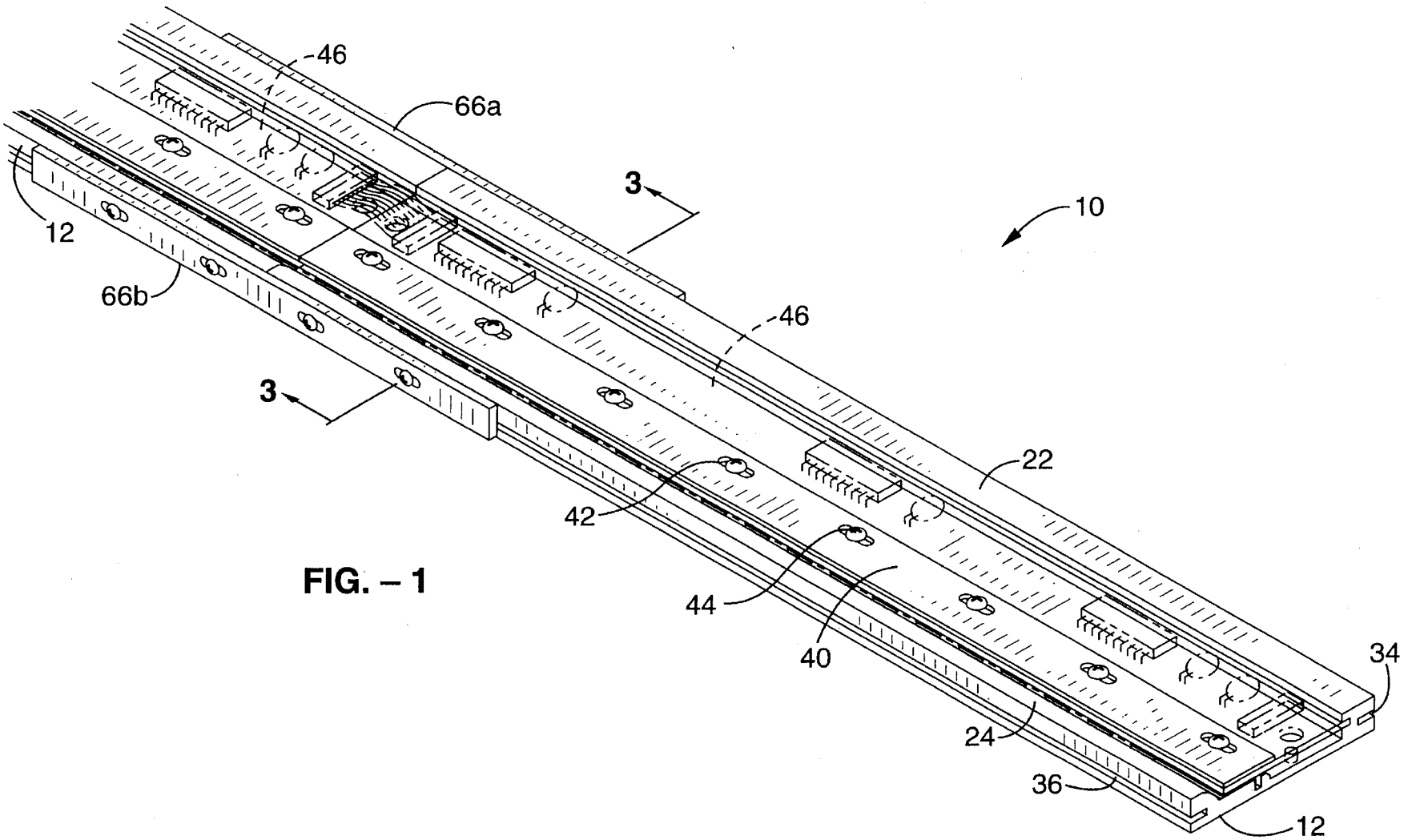
FIG. 1 is a perspective view of a mounting rail assembly in accordance with the present invention showing a pair of mounting rails of the invention coupled in an end-to-end configuration and supporting a pair of recording sensor assemblies shown in phantom.

Referring more specifically to the drawings, for illustrative purposes the present invention is embodied in the apparatus shown generally in FIG. 1 through FIG. 4, where like reference numerals denote like parts. It will be appreciated that the invention may vary as to configuration and as to details of the parts without departing from the basic concepts as disclosed herein.

Figure 2:
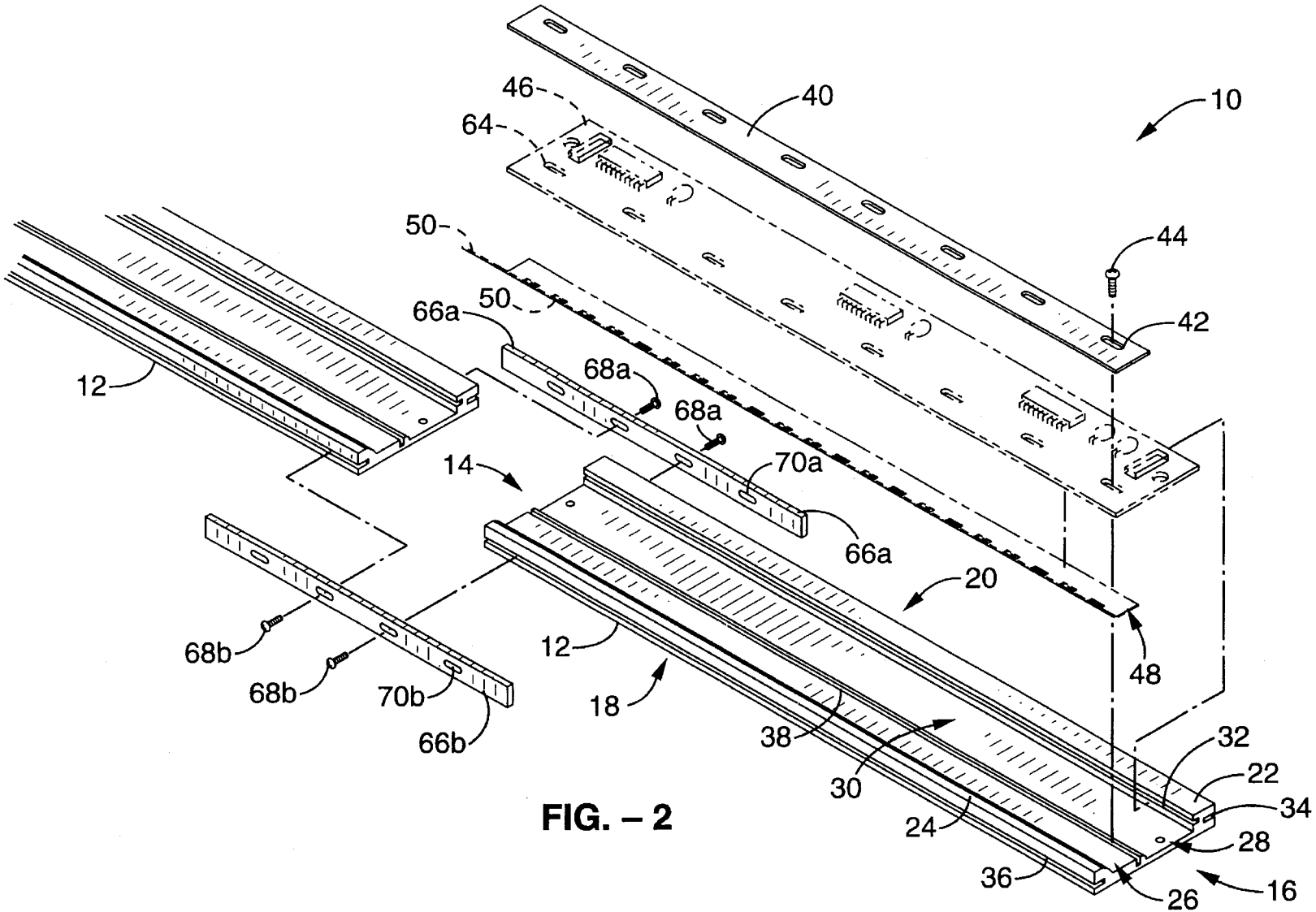
FIG. 2 is an exploded view of the assembly shown in FIG. 1.
Figure 3:
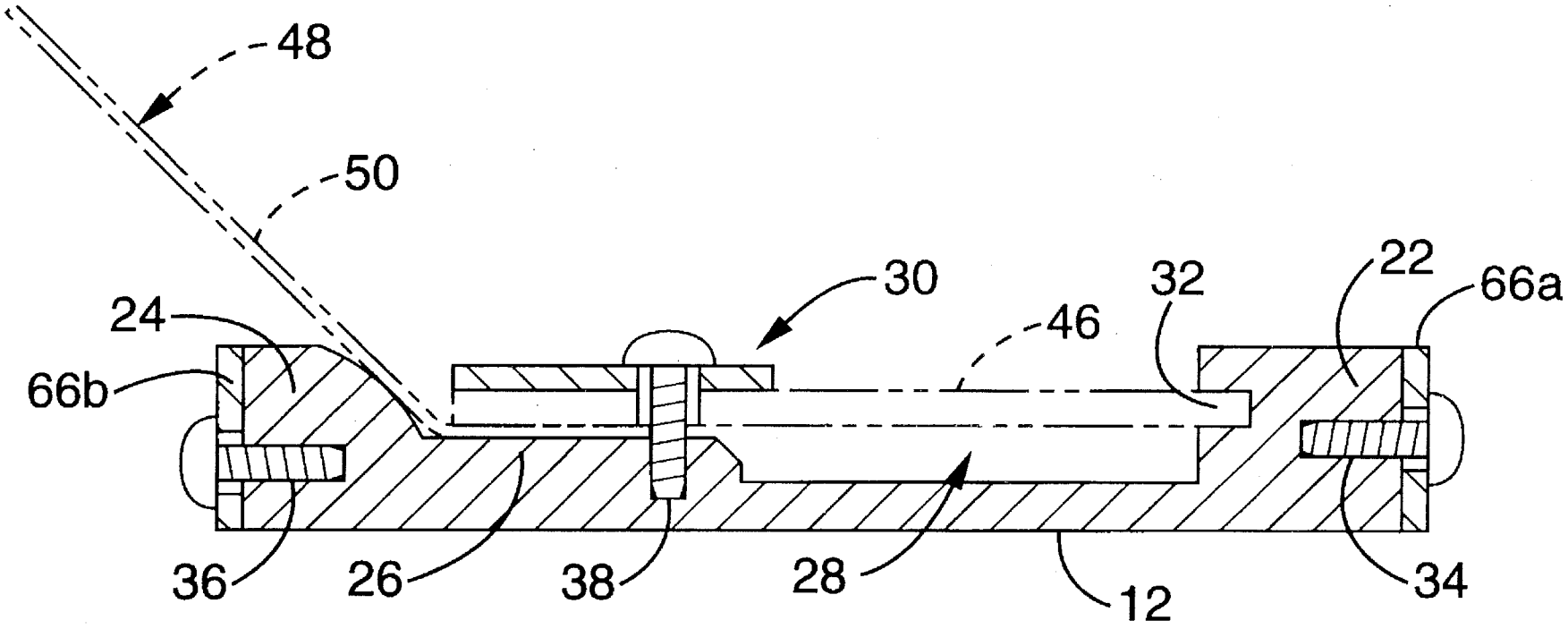
FIG. 3 is a cross-sectional view of a mounting rail shown in FIG. 1 taken through line 3—3 with the recording sensor assembly shown in phantom.

Referring first to FIG. 1 through FIG. 3, a recording sensor mounting rail assembly 10 in accordance with the present invention includes a mounting rail 12 which is preferably extruded from a lightweight material such as aluminum or the like as an elongated member having first and second ends 14, 16, and front and rear sides 18, 20. A rectilinear flange 22 projects upward from the base of mounting rail 12 at the rear side and extends between each end as shown. Further, an arcuate flange 24 projects upward from the base of mounting rail 12 at the front side and extends between each end as shown. Also included is a shelf 26 which is joined to arcuate flange 24 and which projects upward from the base of mounting rail 12 to a height below that of arcuate flange 24 and rectilinear flange 22, thus forming a lower channel 28 between shelf 26 and rectilinear flange 22 as well as an upper channel 30 between arcuate flange 24 and rectilinear flange 22. Rectilinear flange 22 includes a longitudinal slot 32 which opens toward channels 28 and 30, and a longitudinal slot 34 which opens outward from rear side 20. Arcuate flange 24 includes a longitudinal slot 36 which opens outward from front side 18, and shelf 26 includes a longitudinal slot 38 which opens upward and away from the base of mounting rail 12. The apparatus also includes a compression rail 40 having a plurality of elongated slots 42. Compression rail 40 is coupled to mounting rail 12 using fasteners 44, such as self-tapping screws or the like, which extend through slots 42 and into slot 38 in shelf 26.

As can be seen from FIG. 1 through FIG. 3, mounting rail 12 is configured for supporting a recording sensor assembly comprising a circuit board 46 and a sensor strip 48. An example of the construction of sensor strip 48 is described in detail in U.S. Pat. No. 5,237,125 which is owned by the assignee hereof. That patent shows a flexible piezoelectric film sensor strip which produces electric signals when deflected by the piano keys and which is supported by a circuit board, similar to sensor strip 48 and circuit board 46 shown in the drawings herein. In the present invention, sensor strip 48 comprises a plurality of flexible piezoelectric sensor "fingers" 50 which produce electric systems when deflected by the piano keys. The recording sensor assembly is supported by mounting rail 12 by placing one edge of the board into slot 32 and resting the other edge on shelf 26 with sensor strip 48 sandwiched between circuit board 46 and shelf 26. Sensor strip 48 has an insulated mylar lower surface which contacts shelf 26, and electrical contact pads on its upper surface which contact corresponding contact pads on the lower surface of circuit board 46. Contact between sensor strip 48 and circuit board 46 is maintained by compression, which is applied by compression rail 40. Accordingly, the recording sensor assembly is positioned in upper channel 30 as shown, with lower channel 28 providing a void or air space which prevents circuitry on the lower face of circuit board 46 from contacting the metallic surface of mounting rail 12. Further, the arcuate surface of arcuate flange 24 imposes a bend in sensor fingers 50 so that they project upward from mounting rail 12 at an angle and can be articulated over flange 24 by the movement of a piano key.

Figure 4:
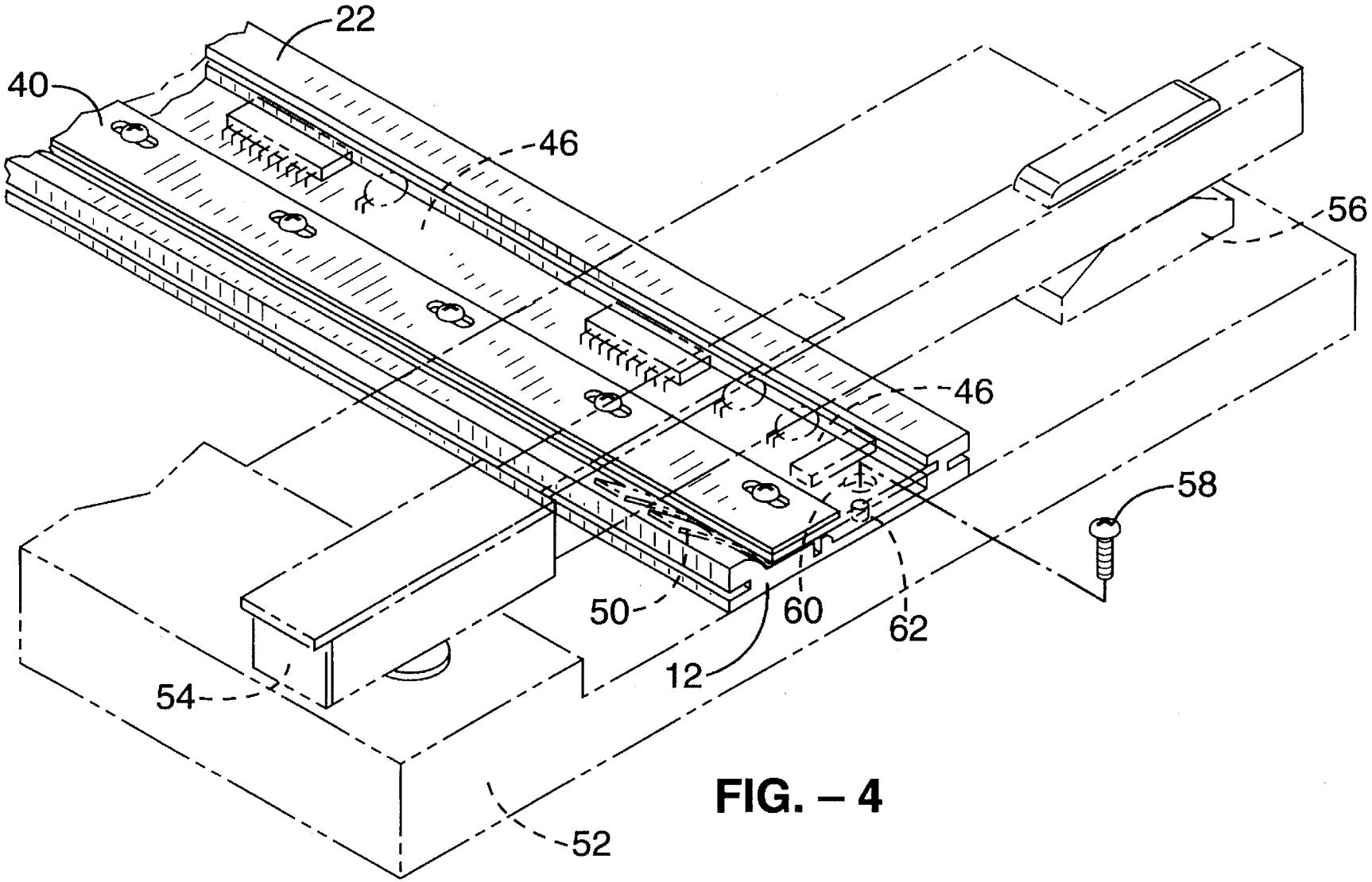
FIG. 4 is a perspective view of a mounting rail of the present invention connected to a typical action assembly of a player piano shown in phantom.

Referring also to FIG. 4, mounting rail 12 is shown coupled to a typical key bed 52 in a piano which includes a plurality of piano keys 54 which pivot about balance rails 56. Mounting rail 12 is positioned between key bed 52 and the keys 54, and coupled to key bed 52 using conventional fastening means such as screws 58 which extend through a hole 60 in circuit board 46, a hole 62 in mounting rail 12, and into key bed 52. Sensor fingers 50 are aligned beneath corresponding keys 54 by adjusting circuit board 46 and sensor strip 48 laterally in relation to mounting rail 12 by means of the slots 42 provided in compression rail 40 and slots 64 provided in circuit board 46. Further, by making the width of sensor fingers 50 less than the width of keys 54, variations in key spacing can be accommodated by lateral adjustment in the foregoing manner.

It will be appreciated, however, that the spacing between the sensor fingers 50 and the keys 54 may differ and, therefore, it may not be possible to properly align sensor fingers 50 with keys 54 in long keyboards since the offset is cumulative and it is possible that a sensor finger could straddle two keys. To solve that problem, it is preferable to limit the size of mounting rail 12 and use multiple such mounting rails in a piano. In this way, the sensor fingers can be aligned beneath corresponding keys in "banks" or segments of a keyboard. For musical instruments such as pianos wherein the keyboard typically has eighty-eight keys, it is preferable that the mounting rail be sized to accommodate a recording sensor assembly having twenty-two sensor fingers. This will allow alignment to be performed in four separate banks of keys, whereby each sensor finger can be aligned beneath a single corresponding key. To facilitate this, multiple mounting rails 12 can be coupled together in an end-to-end configuration as shown in FIG. 1 and FIG. 2 by means of coupling rails 66*a*, 66*b* which are attached to the mounting rails using conventional fasteners 68*a*, 68*b* such as self-taping screws or the like which extend through slots 70*a*, 70*b* in coupling rails 66*a*, 66*b* and into slots 34 and 36 in flanges 22 and 24, respectively.

Accordingly, it will be seen that the recording sensor mounting rail of the present invention provides for convenient mounting of recording sensor assemblies beneath the keys of a keyboard operated musical instrument in a manner which can accommodate different keyboard lengths and varied key spacing. Although the description above includes many specificities, these should not be construed as limiting the scope of the invention but as merely providing illustrations of some of the presently preferred embodiments. Thus, the scope of this invention should be determined by the appended claims and their legal equivalents.

What is claimed is:

1. An apparatus for supporting a recording sensor assembly in a keyboard operated musical instrument, comprising:

(a) an elongated mounting rail, said mourning rail having first and second ends, said mounting rail having front and rear sides;

(b) said mounting rail including means for receiving and supporting a first edge of a recording sensor assembly;

(c) said mounting rail including means for supporting a second edge of a recording sensor assembly under compression; and (d) mounting rail coupling means for coupling said mounting rail to a second mourning rail.

2. An apparatus as recited in claim 1, wherein said mounting rail includes first and second ends and from and rear sides, and wherein said means for receiving and supporting a first edge of recording sensor assembly comprises a rectilinear flange extending longitudinally between said first and second ends along the rear side of said mounting rail, said rectilinear flange including a slot extending longitudinally along said rectilinear flange.

3. An apparatus as recited in claim 2, wherein said means for supporting a second edge of recording sensor assembly under compression comprises:

(a) an arcuate flange extending longitudinally between said first and second ends along the from side of said mounting rail;

(b) a shelf member positioned adjacent to said arcuate flange and extending longitudinally between said first and second ends of said mounting rail;

(c) a compression rail; and (d) compression rail coupling means for coupling said compression rail to said shelf means.

4. An apparatus as recited in claim 3, wherein said mounting rail coupling means comprises:

(a) a first slot, said first slot extending longitudinally between said first and second ends of said mounting rail along said rear side of said rectilinear flange;

(b) a second slot, said second slot extending longitudinally between said first and second ends of said mounting rail along said front side of said arcuate flange;

(c) a first coupling rail;

(d) a second coupling rail;

(e) means extending into said first slot for attaching said first coupling rail to said mounting rail; and (f) means extending into said second slot for attaching said second coupling rail to said mounting rail.

5. A recording sensor assembly mounting apparatus for a keyboard operated musical instrument, comprising:

(a) an elongated mounting rail, said mounting rail having first and second ends, said mounting rail having front and rear sides;

(b) said mounting rail including a rectilinear flange extending longitudinally between said first and second ends along the rear side of said mounting rail, said rectilinear flange including means for receiving and supporting a first edge of a recording sensor assembly;

(c) said mounting rail including an arcuate flange extending longitudinally between said first and second ends along the front side of said mounting rail;

(d) shelf means for supporting a second edge of a recording sensor assembly, said shelf means positioned adjacent to said arcuate flange, said shelf means extending longitudinally between said first and second ends of said mounting rail;

(e) a compression rail;

(f) compression rail coupling means for coupling said compression rail to said shelf means; and (g) mounting rail coupling means for coupling said mounting rail to a second mounting rail, said mounting rail coupling means positioned in said arcuate flange and said rectilinear flange.

6. An apparatus as recited in claim 5, wherein said means for receiving and supporting a first edge of a recording sensor assembly comprises a slot extending longitudinally along said rectilinear flange.

7. An apparatus as recited in claim 5, wherein said mounting rail coupling means comprises:

(a) a first slot, said first slot extending longitudinally between said first and second ends of said mounting rail along said rear side of said rectilinear flange;

(b) a second slot, said second slot extending longitudinally between said first and second ends of said mounting rail along said front side of said arcuate flange;

(c) a first coupling rail;

(d) a second coupling rail;

(e) means extending into said first slot for attaching said first coupling rail to said mounting rail; and (f) means extending into said second slot for attaching said second coupling rail to said mounting rail.

8. An apparatus as recited in claim 5, wherein said compression rail coupling means comprises:

(a) a slot, said slot extending longitudinally between said first and second ends of said mounting rail along said shelf means; and (b) means extending into said slot for attaching said compression rail to said shelf.

9. A mounting rail apparatus for supporting a recording sensor assembly in a keyboard operated musical instrument, comprising:

(a) an elongated mounting rail, said mounting rail having first and second ends, said mounting rail having front and rear sides;

(b) said mounting rail including a rectilinear flange extending longitudinally between said first and second ends along the rear side of said mounting rail, said rectilinear flange including a slot opposite the rear side of said mounting rail, said slot extending longitudinally between said first and second ends of said mount rail;

(c) said mounting rail including an arcuate flange extending longitudinally between said first and second ends along the front side of said mounting rail;

(d) shelf means for supporting a second edge of a recording sensor assembly, said shelf means positioned adjacent to said arcuate flange, said shelf means extending longitudinally between said first and second ends of said mounting rail, said shelf means including a slot extending longitudinally between said first and second ends of said mounting rail along said shelf means; and (e) a compression rail;

(f) compression rail coupling means for coupling said compression rail to said shelf means; and (g) mounting rail coupling means for coupling said mounting rail to a second mounting rail, said mounting rail coupling means positioned in said arcuate flange and said rectilinear flange.

10. An apparatus as recited in claim 9, wherein said mounting rail coupling means comprises:

(a) a first slot, said first slot extending longitudinally between said first and second ends of said mounting rail along said rear side of said rectilinear flange;

(b) a second slot, said second slot extending longitudinally between said first and second ends of said mounting rail along said front side of said arcuate flange;

(c) a first coupling rail;

(d) a second coupling rail;

(e) means extending into said first slot for attaching said first coupling rail to said mounting rail; and (f) means extending into said second slot for attaching said second coupling rail to said mounting rail.

* * * * *